US006868996B1

(12) United States Patent
Uchikoshi

(10) Patent No.: US 6,868,996 B1
(45) Date of Patent: Mar. 22, 2005

(54) BODY TENSION APPARATUS FOR SHIRTS PRESS MACHINE

(75) Inventor: Mitsuyuki Uchikoshi, Tokyo (JP)

(73) Assignee: San Kousha Co., Ltd, Tokyo (JP)

( * ) Notice: Subject to any disclaimer, the term of this patent is extended or adjusted under 35 U.S.C. 154(b) by 20 days.

(21) Appl. No.: 10/611,713

(22) Filed: Jul. 1, 2003

(51) Int. Cl.[7] ..... D06C 15/00

(52) U.S. Cl. ..... 223/61; 223/74

(58) Field of Search ..... 223/67, 74, 61, 223/66, 73; 38/88, 143

(56) References Cited

U.S. PATENT DOCUMENTS 3,063,606 A * 11/1962 Davis ..... 223/57
3,170,610 A * 2/1965 Kannegiesser et al. ..... 223/57

* cited by examiner

*Primary Examiner*—John J. Calvert
*Assistant Examiner*—James G. Smith

(74) *Attorney, Agent, or Firm*—Andrus, Sceales, Starke & Sawall, LLP

(57) ABSTRACT

This invention relates to an apparatus for extending the side portions of the shirts put on the dummy toward a side. An object of the present invention enables the side portions of the shirts to be protruded toward the side strictly in compliance with the curved lines by a simple configuration without increasing its cost and further enables the body part of the shirts to be tensioned. The present invention is comprised of side pressing members arranged longitudinally at both sides of the dummy, and driving devices for protruding the side pressing members toward the sides of the dummy. The side pressing members are formed into a bow-like shape with their concave surfaces being faced to the side portions of the dummy. In addition, flexible wire members abutted against the inner surfaces of the side portions of the shirts are applied in tension in a chord-like manner at an upper end and a lower end of each of the side pressing members. The side pressing members are tensioned by the driving devices and the wire members are pushed against the inner surfaces of the side portions of the shirts, resulting in that the wire members are curved along the lines at the side portions of the shirts to cause the side portions of the shirts to be extended strictly in compliance with the curved lines.

6 Claims, 4 Drawing Sheets

BODY TENSION APPARATUS FOR SHIRTS PRESS MACHINE

BACKGROUND OF THE INVENTION

1. Field of the Invention

This invention relates to a body tension apparatus for a shirts press machine, and more particularly a body tension apparatus for a shirts press machine in which the shirts is pressed with a pair of front and rear press irons under a state in which the shirts is put on a dummy, the sides of the shirts are extended to enable a clean pressed state of the body of the shirts to be attained.

2. Description of the Related Art

As this type of prior art apparatus, the apparatus disclosed in the gazette of U.S. Pat. No. 5,722,572, for example, has been provided. This type of prior art apparatus is constructed such that it is comprised of side pressing members arranged longitudinally at both sides of a dummy and cylinders for protruding the side pressing members toward sides of the dummy.

In this arrangement, there has been frequently found that the shirts such as a white-shirts is normally narrowed from the side to the waist and it is sewn to be diverged as it approaches from the waist to the lower skirt part. Accordingly, the lines at the side portions of the shirts are formed into a curved-shape and its curved line is made different in response to its size or design.

Accordingly, this type of apparatus is preferably formed such that even if the size or design of the shirts is different, the entire side portions are protruded toward side portions strictly in response to the curved lines to enable the body part of the shirts to be tensioned.

Thus, in this case, a complicated structure of the apparatus causes either a component cost or a manufacturing cost to be increased. Accordingly, it is desirable that this type of apparatus is formed such that the side portions of the shirts can be extended strictly in compliance with the curved lines by a simple configuration without producing any increase in cost.

This invention has been proposed in view of such prior art problems as described above.

Accordingly, the technical problem of the present invention is to provide a body tension apparatus of a shirts press machine in which the side portions of the shirts put on the dummy are protruded toward a side part strictly in compliance with the curved line by a simple configuration without increasing any cost to enable the body part of the shirts to be tensioned and formed.

SUMMARY OF THE INVENTION

As shown in FIG. 1 and the like, the present invention is comprised of side pressing members arranged longitudinally at both sides of a dummy on which a shirts is put and driving devices for use in tensioning the side pressing members to the side portions of the dummy. Then, the aforesaid side pressing members are formed in a bow-like shape with their concave surfaces being faced toward the sides of the dummy and flexible wire members abutted against the inner surfaces of the side portions of the shirts are tensioned in a chord-like manner at an upper end and a lower end of each of the side pressing members.

In the case of the present invention, it is preferable that the side pressing members are of members in which the wire members are tensioned over the upper and lower ends.

Accordingly, the bow-like shape in this case is not limited to the arcuate shape and another shape of a staple needle of a stapler, for example, can also be applied. In addition, in the case of the present invention, the driving devices are realized by either a pneumatic cylinder or a motor and the like, for example. A driving force of the driving device is transmitted to the side pressing members through either a link mechanism or a gear mechanism.

Further, it is preferable in the present invention that the outer ends of the supporting members for supporting the side pressing members are pivotally arranged at substantial central positions of the side pressing members, and the side pressing members are formed such that they can be inclined in a lateral direction of the dummy around the pivot portions with the supporting members.

Because, in accordance with the arrangement above, the side pressing members are inclined, resulting in that the wire members can be more easily fitted to the shirts having different sizes or different curved shapes to each other.

In accordance with this arrangement above of the present invention, if a material quality of the wire members is flexible, a metallic round rod and a round rod of heat-resistance resin and the like can be optionally applied as their material quality. In these materials, it is preferable that a coil spring is usually selected as each of the wire members. Because, the coil spring not only enables a parts cost to be reduced, but also its metallic material is hardly influenced by heat of steam blown from inside the dummy to the shirts, resulting in that its durability is improved and its round circumferential surface does not cause any traces to be left at the shirts.

Additionally, it is preferable in the present invention that the flexible core materials are stored in the wire members in a longitudinal direction of each of the wire members. In this case, the core members can properly hold a flexible state of the wire members and enable the wire members to be fit more properly to the side lines of the shirts. As the core members, there may be employed either a metallic rod or rod of heat-resistant resin or a rod with polygonal sectional shape, for example. In these materials, it is preferable as the core members to employ the metallic rod in view of the fact that the metallic rod has a superior durability or superior hear-resistant characteristic.

As described above, the present invention has been constituted, resulting in that the side portions of the shirts can be extended strictly in compliance with the curved lines and its relative simple structure enables the component cost and manufacturing cost to be restricted.

DETAILED DESCRIPTION OF THE PREFERRED EMBODIMENTS

Referring now to the accompanying drawings, one preferred embodiment of the present invention will be described as follows.

Figure 1:
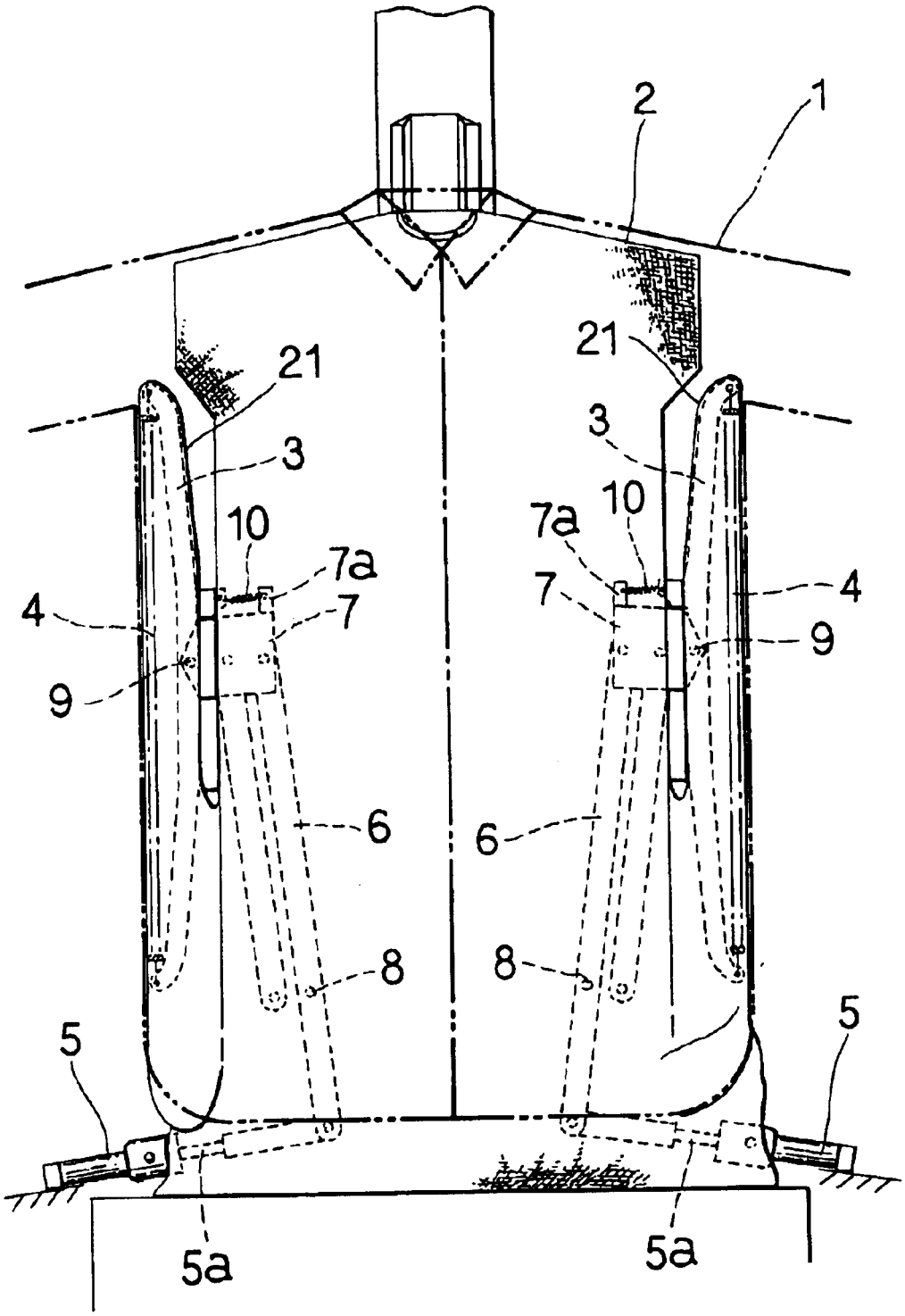
FIG. 1 is a front elevational view for showing a substantial part of one preferred embodiment of the apparatus of the present invention with a part being cut away.
Figure 2:
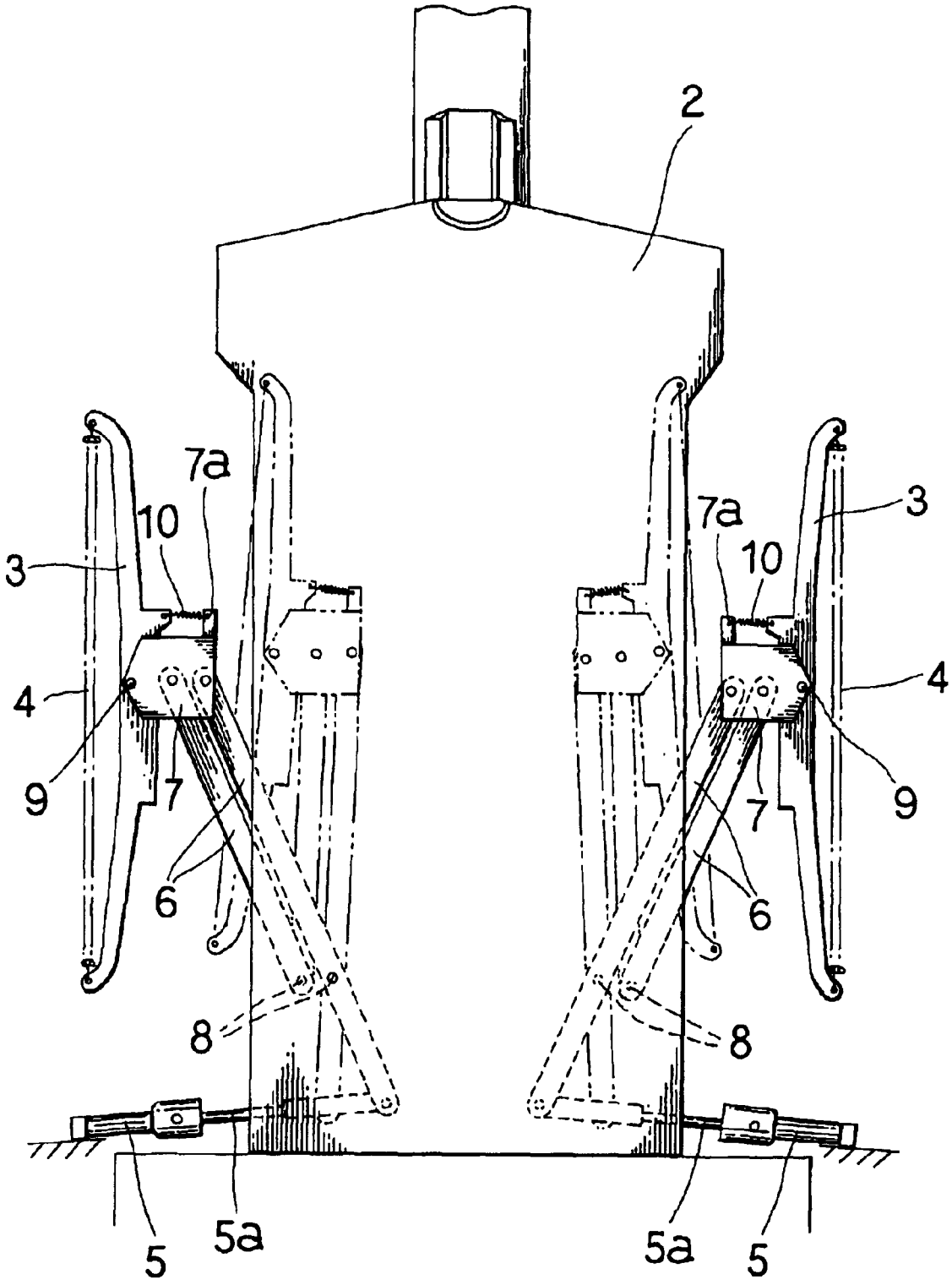
FIG. 2 is a front elevational view for showing a substantial part kept in a state in which a cover is removed.
Figure 3:
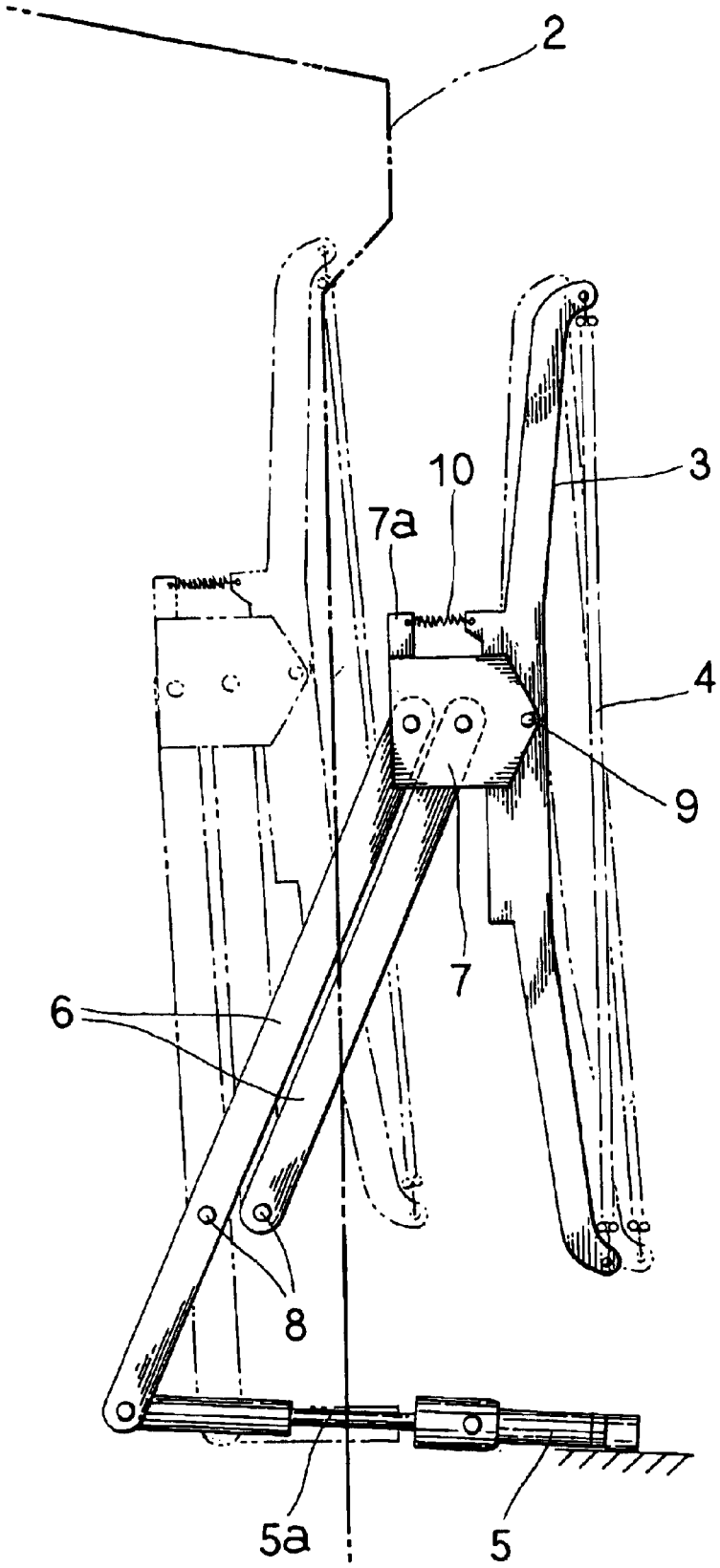
FIG. 3 is an enlarged front elevational view for showing a substantial part of the apparatus of the present invention.

As shown in FIG. 1 and the like, the apparatus of the present invention is comprised of side pressing members 3 arranged longitudinally at both sides of a dummy 2 on which shirts 1 is installed; and driving devices 5 for use in protruding the side pressing members 3 toward the sides of the dummy 2. The side pressing members 3 are formed into a bow-like shape with a concave surface being faced toward the dummy 2. Reference numeral 4 denotes a flexible wire member applied to the inner surface of the side portion of the shirts 1.

The side pressing members 3, in this preferred embodiment, are arranged such that they can be protruded at the side portions of the dummy 2 by pneumatic cylinders acting as the driving devices 5. Each of the pneumatic cylinders acting as the driving devices 5 is installed in a lateral orientation at each of the lower lateral positions of the dummy 2 with their rods 5*a* being faced inwardly of the dummy 2. Extremity end of the rod 5*a* is pivotally arranged at a lower inner end of each of the supporting members 6.

A pair of parallel plate pieces form the supporting members 6. Reference numeral 7 denotes a connecting plate fixed to an upper outer end of the supporting member 6. The outer end of the supporting member 6 is pivotally arranged at a substantial central position of the side pressing member 3 through this connecting plate 7. Reference numeral 9 denotes a pivot pin acting as a pivot part. This pivot pin 9 is arranged with its axis being faced horizontally along a forward or rearward direction of the dummy 2. The side pressing members 3 are turned around the pivot pins acting as the pivot parts 9 in a lateral direction of the dummy 2 and inclined. In addition, the supporting members 6 are pivoted at the dummy 2 through supporting shafts 8.

In the case of the present invention in reference to its preferred embodiment, raised pieces 7*a* are raised at inside upper portions of the connecting plates 7, and the upper ends of the raised pieces 7*a* and the outer edge positions at the corresponding rear sides of the side pressing members 3 are connected by tension springs 10. The tension spring 10 is used for facilitating a returning action of the side pressing member 3 when the side pressing member 3 is inclined around the pivot part 9 along the curved line of the side part of the shirts 1. Further, the side pressing member 3 is covered by a cover 21 together with the dummy 2.

Figure 4:
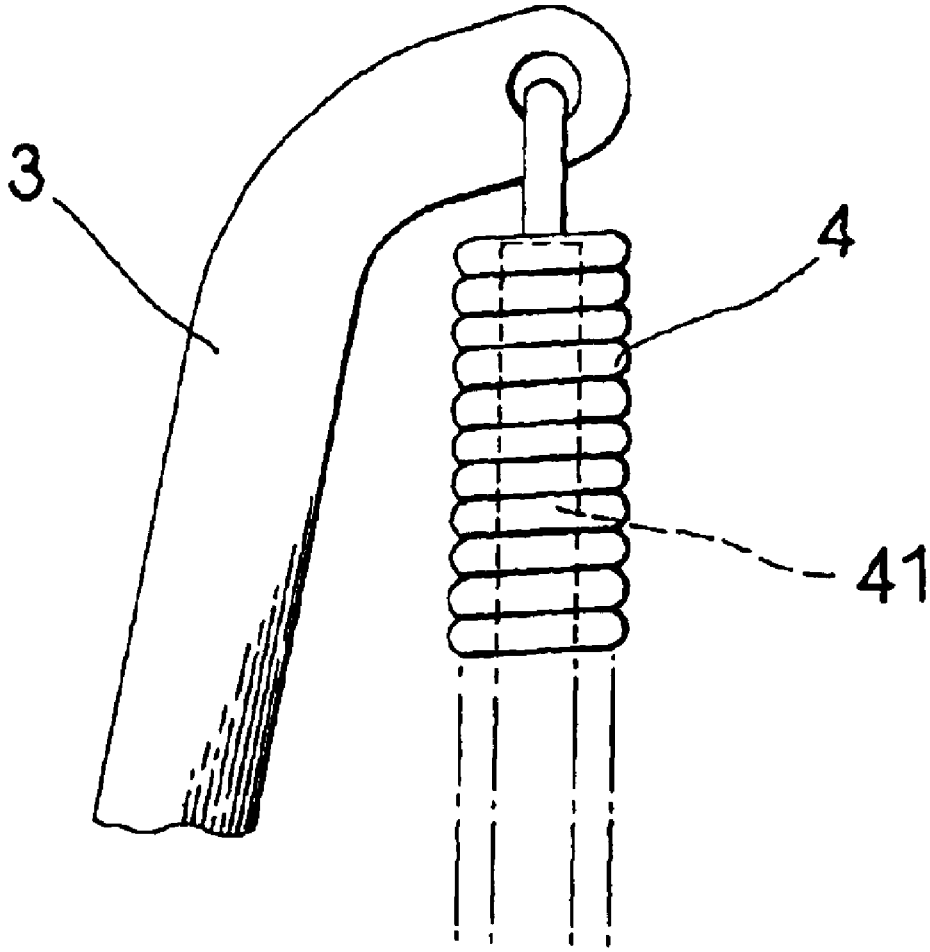
FIG. 4 is an enlarged front elevational view for showing a substantial part of the wire members of one preferred embodiment.

In this preferred embodiment, the aforesaid wire member 4 is constituted by a thin cylindrical coil spring. The coil spring acting as this wire member 4 is set such that hooks at both ends are engaged with an upper end and a lower end of the side pressing member 3 and it is tensioned like a chord between the upper end and the lower end of the side pressing member 3. Further, as shown in FIG. 4, the wire member 4 comprises a flexible wick material 41 in the longitudinal direction of the wire member 4, which is a metallic rod in the preferred embodiment.

Action of the present invention in accordance with this preferred embodiment will be described as follows.

At first, the pneumatic cylinder acting as the driving device 5 is driven under a state in which the shirts 1 is set at the dummy 2 to cause the rod 5*a* to be extended. Then, the inner end of the lower side of the supporting member 6 is pushed inwardly of the dummy 2, so that the upper outer end of the supporting member 6 is turned to the side of the dummy 2 around the supporting shaft 8. As a result, the side pressing member 3 connected to the supporting member 6 is tensioned at the side part of the dummy 2.

Then, the wire member 4 tensioned by the side pressing member 3 is pushed against the side inner surface of the shirts 1 and causes the side portions of the shirts 1 to be extended toward the side part of the dummy 2 while the wire member 4 is being flexed along the inside curved line of the shirts 1. With such an arrangement, the body part of shirts 1 is tensioned. Then, a pair of front and rear pressing irons under this state press the body part of the shirts 1.

Then, upon completion of the pressing operation for the shirts 1, the rods 5*a* of the pneumatic cylinders acting as the driving devices 5 are retracted. Then, the supporting members 6 are turned around the supporting shafts 8 in a direction opposite to the aforesaid direction, and the upper outer ends of the supporting members 6 are turned to the side of the dummy 2. With this operation above, the side pressing members 3 are retracted and stored inside the dummy 2.

With the foregoing, although the pneumatic cylinders acting as the driving devices 5 in the aforesaid preferred embodiment are arranged separately at the right and left side pressing members 3, the present invention is not limited to this arrangement. That is, it is also applicable that the present invention can be configured such that one unit of the driving device 5 is arranged at the lower central position of the dummy 2, for example, and the right .and left side pressing members 3 are advanced or retracted simultaneously to the side of the dummy 2 with this one unit of the driving device 5.

What is claimed is:

1. A body tension apparatus for shirts press machine comprised of side pressing members arranged longitudinally at both sides of a dummy on which a shirts is put; and driving devices for protruding the side pressing members to the side portions of the dummy, the side pressing members being formed into a bow-like shape with concave surfaces facing away from the side portions of the dummy and flexible wire members being tensioned in a chord-like manner at upper and lower ends of the side pressing members.

2. A body tension apparatus for shirts press machine according to claim 1, wherein outer ends of the supporting members for supporting the side pressing members are pivotally attached to a substantial central position of the side pressing member, and the side pressing members are formed in such a way that they can be inclined in a lateral direction of the dummy around the pivot part with the supporting member.

3. A body tension apparatus for shirts press machine according to claim 1, wherein the wire members are coil springs.

4. A body tension apparatus for shirts press machine according to claim 1, wherein the wire members are metallic round rods.

5. A body tension apparatus for shirts press machine according to claim 3, wherein the flexible wick material are formed in the wire members in the longitudinal direction of the wire members.

6. A body tension apparatus for shirts press machine according to claim 5, wherein the wick members are metallic rods.

* * * * *